US005568831A

United States Patent [19]

Blackwell

[11] Patent Number: 5,568,831

[45] Date of Patent: Oct. 29, 1996

[54] MULTI-SCENE SASH FRAME

[76] Inventor: Chadwick C. Blackwell, Rte. 2, Box 935, Grottoes, Va. 24441

[21] Appl. No.: 441,051

[22] Filed: May 15, 1995

[51] Int. Cl.[6] ..... A47H 1/00

[52] U.S. Cl. ..... 160/98; 160/108

[58] Field of Search ..... 160/108, 109, 160/110, 111, 112, 85, 86, 98

[56] References Cited

U.S. PATENT DOCUMENTS

| | | | |
|---|---|---|---|
| 938,147 | 10/1909 | Hughes et al. | 160/108 |
| 1,636,601 | 7/1927 | Givens | 160/108 X |
| 2,175,761 | 10/1939 | Quinlan | 160/108 X |
| 2,395,073 | 2/1946 | Schepmoes | 160/85 |
| 3,128,688 | 4/1964 | Coda | 160/85 X |

*Primary Examiner*—David M. Purol

[57] ABSTRACT

A moveable, hangable sash frame for the convenient display of changeable scenes. The changeable scenes include a removable stationary primary scene and a removable secondary scene on a roller, which allows for rapid change of viewing from one scene to another scene. Either one, or both scenes can be quickly and easily removed and replaced with a different scene(s).

2 Claims, 1 Drawing Sheet

MULTI-SCENE SASH FRAME

BACKGROUND OF INVENTION

1. Field of Invention

This invention is related to wall decorations of the hangable type and, more specifically, to sash frames having changeable and also removable scenes for viewing pleasure.

2. Prior Art

Wall decorative hangings present photographs and pictures as a single presentation. The ability to conveniently change the viewed scene to match a mood or to create a decorative effect and the ability to conveniently remove and replace scenes, is not presently available.

SUMMARY OF INVENTION

It is the object of this invention to provide a facilely moveable and hangeable sash frame for the purpose of viewing decorative scenes.

It is another object of this invention to provide for viewing multi-scenes one at a time.

It is a further object of this invention to provide a convenient means of removing and replacing scene(s).

DESCRIPTION OF THE PREFERRED EMBODIMENTS

Figure 1:
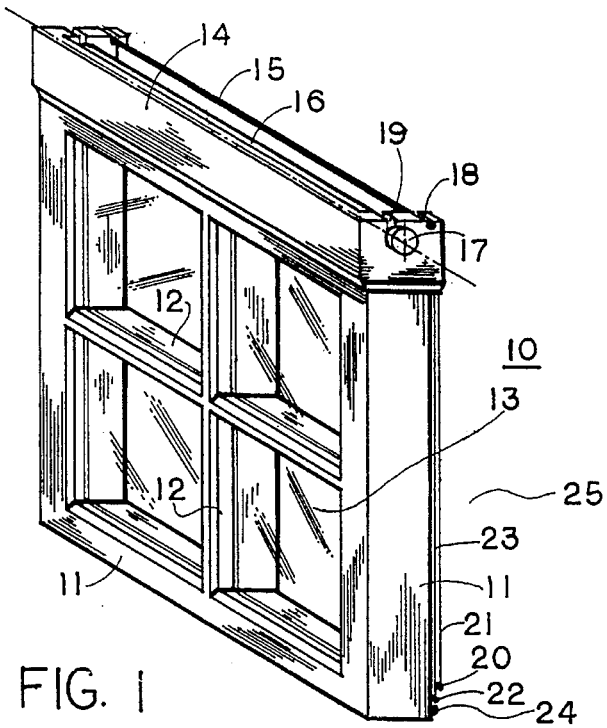
FIG. 1 is a perspective view of the sash frame assembly showing the top hung scenes, the rear scene being referred to as the "primary scene" and the from roller scene being referred to as the "secondary scene." Glass-like material is shown in FIG. 1 and later in FIG. 2, and FIG. 5. Four panels are shown, however the number of panels may vary to produce desired viewing affect. A scene is not shown in this perspective view.

Referring to the drawing in detail and particularly to FIG. 1, there is shown the moveable, hangable decorative sash frame assembly 10. This assembly consists of perimeter members 11 along with interior members 12. Clear, glass-like material 13 may be eliminated for constructive simplicity. The top area of the assembly is formed with a three-sided casement 14, which provides a covering for the roller area and a support for the primary scene rod hanger 15 and the secondary scene roller hanger 16. The secondary scene hanger end knob 17 is shown. Rod hanger slot 18 allows for the placement of the primary scene rod hanger 15. Roller hanger slot 19 allows for the placement of the secondary scene roller hanger 16. At the bottom rear sides, the primary scene weight rod 20 is shown, which applies tension to the primary scene 21. Also shown is the secondary scene weight rod 22 for the secondary scene 23. In this same area, a spacer-bumper 24 is shown, which provides proper space between the sash frame assembly 10 and the adjacent surface 25.

Figure 2:
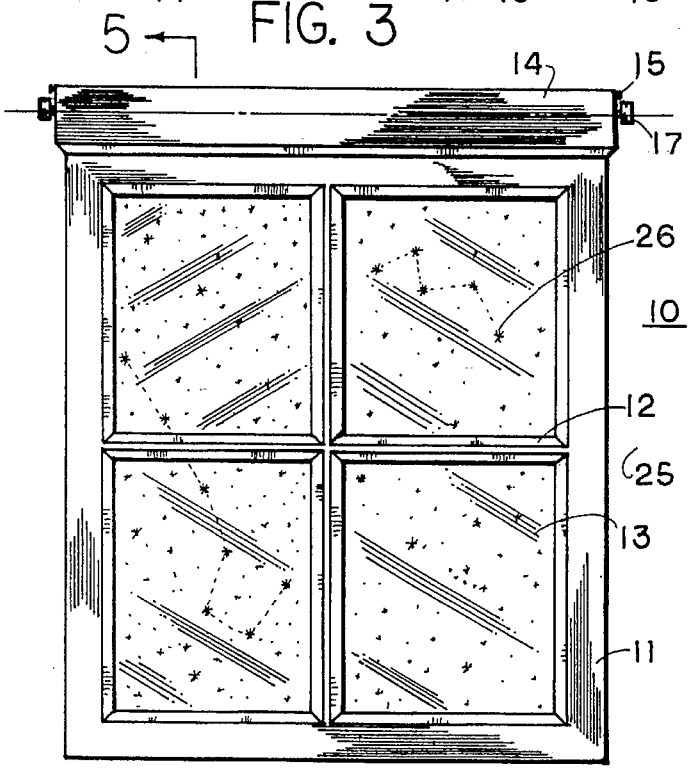
FIG. 2 is a front elevation showing the sash frame assembly with the top area cased to hide the scene rod hanger and scene roller hanger. A typical scene of celestial stars is shown in reverse video for clarity.

Referring to FIG. 2, there is shown a front elevation of the sash frame assembly 10 with example celestial scene 26, shown in reverse video. The assembly perimeter members 11 and internal members 12 are shown along with the glass-like material 13. The top area casement 14 is also shown with the second scene hanger end knob 17 and rod hanger 18.

Figure 3:
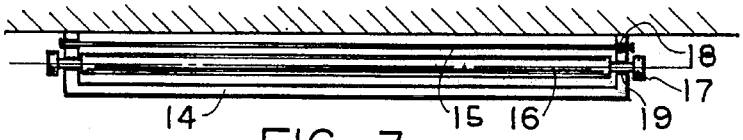
FIG. 3 is a plan view of the top of said sash frame assembly, showing the top casing, the rear rod hung primary scene, and the front roller hung secondary scene.

Referring to FIG. 3, there is shown a top view of the casement 14 along with the primary scene rod hanger 15, secondary scene roller hanger 16, secondary scene roller hanger end knob 17, rod hanger slot 18, and the roller hanger slot 19.

Figure 4:
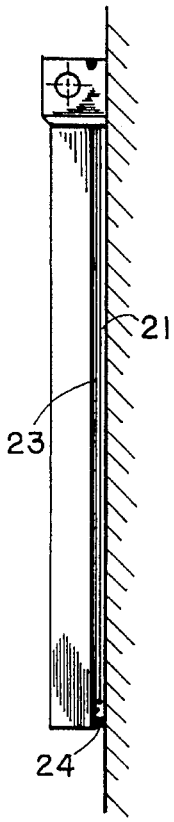
FIG. 4 is a side elevation of the sash frame assembly, showing the top cased area. Also shown is the primary scene rod hanger end and the secondary scene roller end knob.

Referring to FIG. 4, a side elevation exhibiting the relationship between the primary scene 21 and the secondary scene 23 within the rear side space, provided by the spacer-bumper 24.

Figure 5:
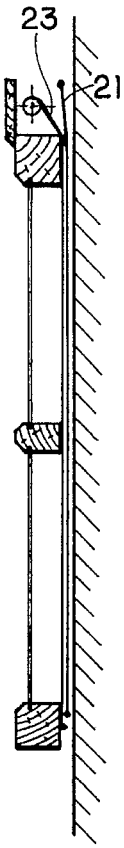
FIG. 5 is a vertical cross-section of the sash frame assembly, showing the sash members, and the top casing. The top hanger rod is shown along with the hanging primary scene and bottom weight rod. Also shown is the roller hanger and the secondary scene hanging as the presently viewable scene, along with its bottom weight rod. This secondary scene would be rolled up to its top position to make viewable the primary scene.

Referring to FIG. 5, which is a vertical section of the sash frame, there is shown the routing of the primary scene 21 and the secondary scene 23.

I claim:

1. A moveable, hangable sash frame assembly comprising:

a sash frame including first and second vertical members each having a first end and a second end, a bottom horizontal member having a first end secured to the second end of said first vertical member and a second end secured to the second end of said second vertical member, an upper horizontal member having a first end secured to the first end of said first vertical member and a second end secured to the first end of said second vertical member;

a plurality of interior members disposed within said sash frame.

2. The moveable, hangable sash frame assembly according to claim 1 further comprising glass material supported by said interior members of said sash frame.

* * * * *